US010100551B2

(12) United States Patent
Pacheco

(10) Patent No.: US 10,100,551 B2
(45) Date of Patent: Oct. 16, 2018

(54) FENCE POST CAP

(71) Applicant: 1461043 Ontario Limited, Bolton (CA)

(72) Inventor: Carlos Pacheco, Bolton (CA)

( * ) Notice: Subject to any disclaimer, the term of this patent is extended or adjusted under 35 U.S.C. 154(b) by 0 days.

(21) Appl. No.: 15/486,774

(22) Filed: Apr. 13, 2017

(65) Prior Publication Data

US 2017/0314292 A1 Nov. 2, 2017

Related U.S. Application Data

(63) Continuation of application No. 12/971,984, filed on Dec. 17, 2010, now abandoned.

(60) Provisional application No. 61/297,440, filed on Jan. 22, 2010.

(51) Int. Cl.
*E04H 17/20* (2006.01)
*E04H 17/00* (2006.01)

(52) U.S. Cl.
CPC ..... *E04H 17/20* (2013.01); *E04H 2017/006* (2013.01)

(58) Field of Classification Search
CPC ..... E04H 17/20; E04H 2017/006
USPC ..... 411/521, 522; 256/1, 19, 21; D25/135; 52/301
See application file for complete search history.

(56) References Cited

U.S. PATENT DOCUMENTS 2,720,289 A * 10/1955 Henrickson ..... E04B 5/10 16/87.2
4,789,138 A * 12/1988 Acton ..... E04H 17/14 256/1
5,421,556 A * 6/1995 Dodge ..... E04H 17/20 256/1
6,662,515 B2 * 12/2003 Buhrts ..... E04H 17/20 256/1
7,028,991 B2 * 4/2006 Egan ..... E04H 17/20 256/1
D654,384 S * 2/2012 McDonald ..... D10/66
2003/0122115 A1 * 7/2003 Ernst ..... E04H 17/20 256/1

(Continued)

*Primary Examiner* — Joshua T Kennedy
(74) *Attorney, Agent, or Firm* — Husch Blackwell LLP

(57) ABSTRACT

A fence post cap is fabricated of thin-walled material with a cap portion above a plurality of depending walls. A first wall has an inwardly and upwardly extending thin-walled first protrusion with a first upper edge providing a mouth between the first wall adjacent the first upper edge and the first upper edge. Likewise, a second side wall, opposite the first side wall, has an inwardly and upwardly extending thin-walled second protrusion with a second upper edge providing a mouth between the second side wall adjacent the second upper edge and the second upper edge. The protrusions can be positioned so that they are opposite one another such that a shortest distance between the first wall adjacent the first protrusion and the second wall adjacent the second protrusion is greater than a shortest distance between the first wall inwardly extending portion and the second wall inwardly extending portion. Each protrusion can be a wall of a dimple that inclines inwardly and upwardly to an upper edge where the upper edge is separated from the side wall from which the dimple extends. The dimple wall can have a notch extending from this upper edge. The cap can be a unitary structure fabricated of sheet metal.

12 Claims, 8 Drawing Sheets

(56) References Cited

U.S. PATENT DOCUMENTS

Figure 1:
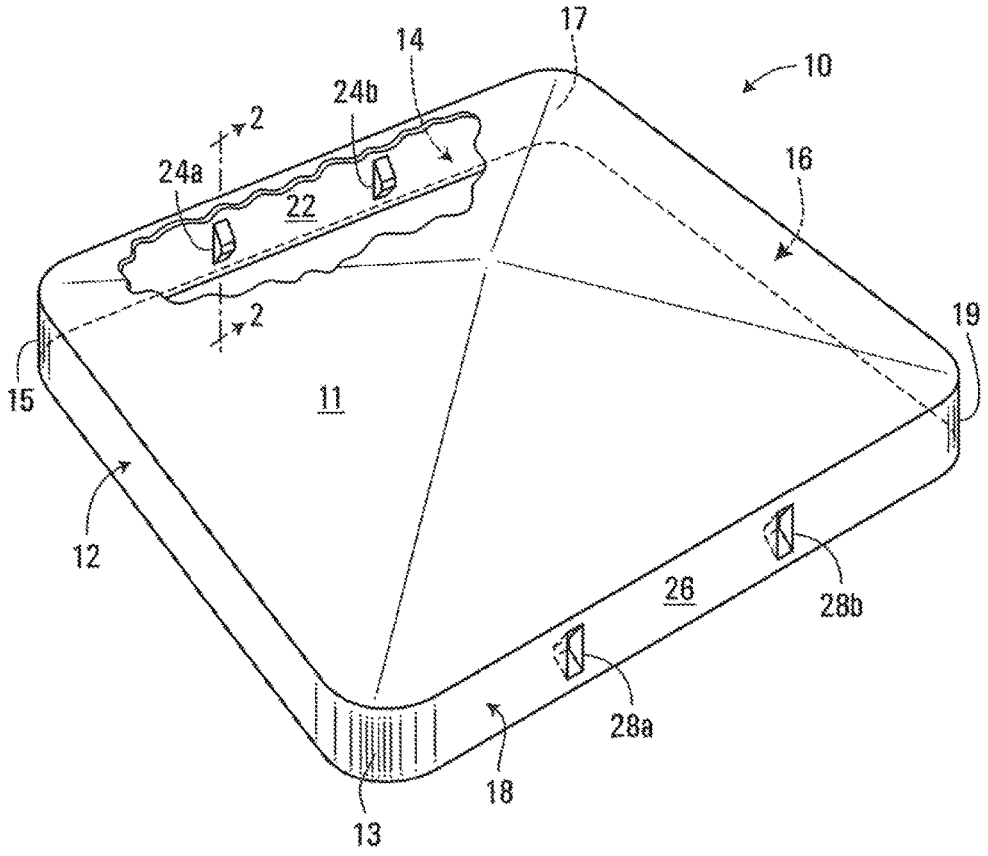

2003/0160226 A1* 8/2003 Steffes ..... E04H 17/1434
256/65.01

* cited by examiner

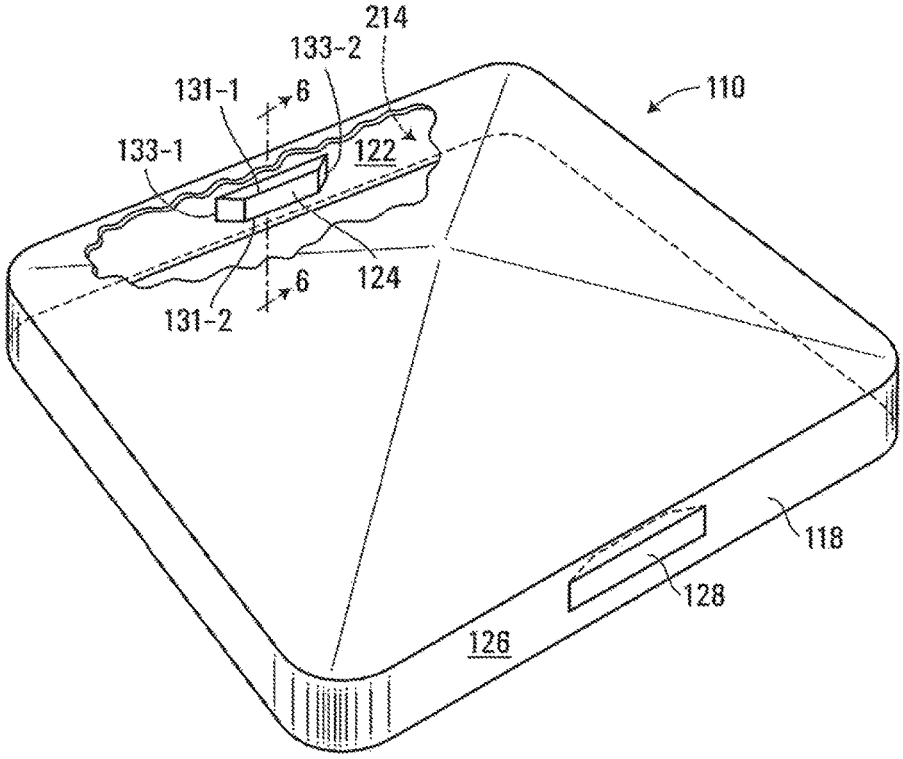
FIG. 5
FIG. 6
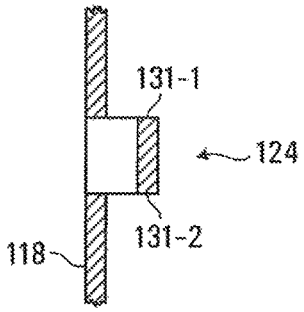

FENCE POST CAP

CROSS-REFERENCE TO RELATED APPLICATION

This application is a continuation of U.S. patent application Ser. No. 12/971,984 filed Dec. 17, 2010, which application claims benefit and priority from U.S. provisional patent application No. 61/297,440, filed on Jan. 22, 2010, the contents of which are incorporated herein by reference.

BACKGROUND

This invention relates to a fence post cap, an assembly including a fence post cap, and a method of making a fence post cap.

To increase the attractiveness and durability of a fence post, such as a wooden, vinyl, or fiberglass post, it is known to cap the post. A post cap is typically fitted over the top of the post and secured in place by screws, nails, or an adhesive. It is often required that the fence post have a completely level top surface so that the post cap itself will be level. This may require cutting the top of the fence post level in the field, but such a procedure is labour intensive.

This invention seeks to provide an improved fence post cap.

SUMMARY

A fence post cap is fabricated with inwardly directed protrusions so that, during installation on a fence post, the cap is press fit to the post.

In one embodiment, a fence post cap is fabricated of a thin-walled material. The structure has a cap portion above a plurality of depending walls. A first wall of the walls has an inwardly and upwardly extending thin-walled first protrusion with a first upper edge providing a mouth between said first wall and said first upper edge. A second wall of the walls, opposed to said first wall, has an inwardly and upwardly extending thin-walled second protrusion with a second upper edge providing a mouth between said second wall and the second upper edge.

In another embodiment a unitary fence post cap is fabricated of sheet metal with a sheet metal cap portion above a plurality of depending sheet metal walls. A first wall has an inwardly extending bent sheet metal portion. Likewise, a second wall, opposite the first wall, has an inwardly extending bent sheet metal portion. The inwardly extending bent sheet metal portions are positioned so that they are opposite one another such that a shortest distance between the first wall adjacent the first wall inwardly extending bent sheet metal portion and the second wall adjacent the second wall inwardly extending bent sheet metal portion is greater than a shortest distance between the first wall inwardly extending bent sheet metal portion and the second wall inwardly extending bent sheet metal portion.

In a further embodiment, a fence post cap is fabricated of a thin-walled material with a cap portion above a plurality of depending walls. A first wall has an inwardly extending thin-walled first dimple. A second wall, opposed to said first wall, has an inwardly extending thin-walled second dimple. The first dimple has a first dimple wall inclining inwardly and upwardly to a first upper edge. The first upper edge is separated from an adjacent portion, of the first wall and the first dimple wall has a notch extending frond first upper edge. The second dimple has a second dimple wall inclining inwardly and upwardly to a second upper edge, the second upper edge being separated from an adjacent portion of the second wall. The second dimple wall has a notch extending from the second upper edge.

In another embodiment, a method of making a fence post cap involves die punching a single piece of sheet metal so as to form a first unitary structure having a sheet metal cap portion and a plurality of depending sheet metal walls. The method continues with die punching the first unitary structure so that a first wall of the walls has an inwardly extending bent sheet metal portion and an opposite second wall has an inwardly extending bent sheet metal portion, where the first wall inwardly extending bent sheet metal portion is opposed to the second wall inwardly extending bent sheet metal portion and a shortest distance between the first wall adjacent the first wall inwardly extending bent sheet metal portion and the second wall adjacent the second wall inwardly extending bent sheet metal portion is greater than a shortest distance between the first wall inwardly extending bent sheet metal portion and the second wall inwardly extending bent sheet metal portion.

Other features and advances will become apparent from the following description in conjunction with the drawings.

DRAWINGS

Figure 1A:
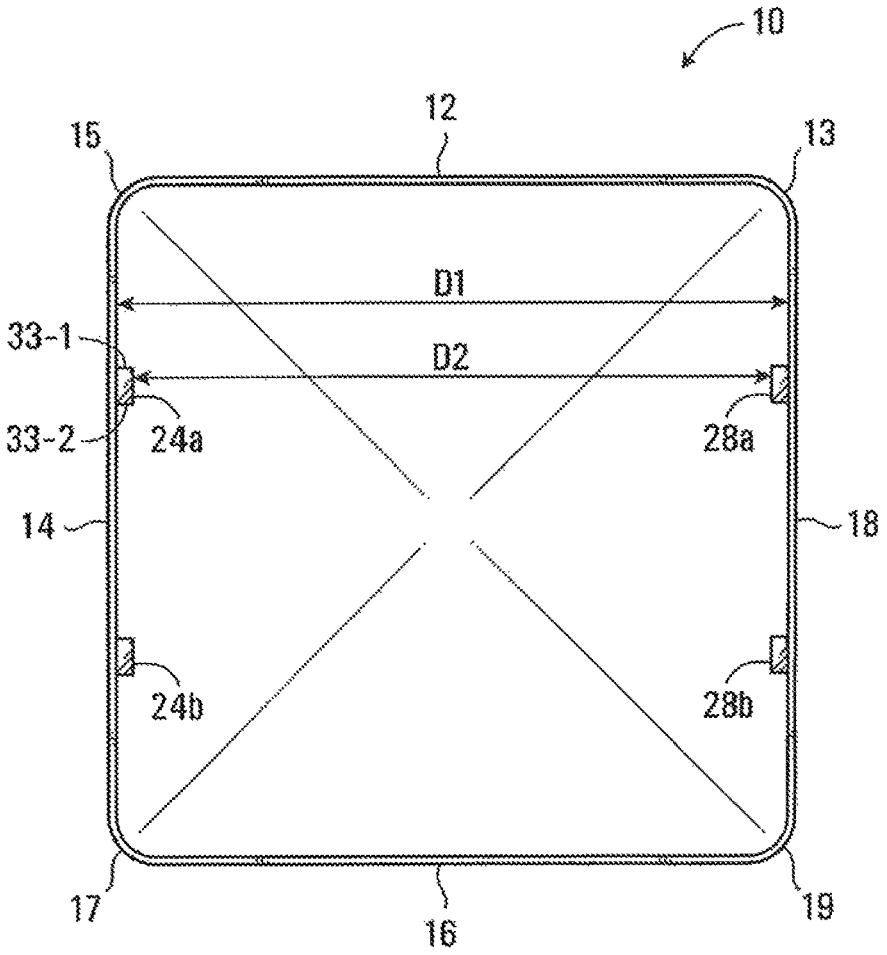
Figure 2:
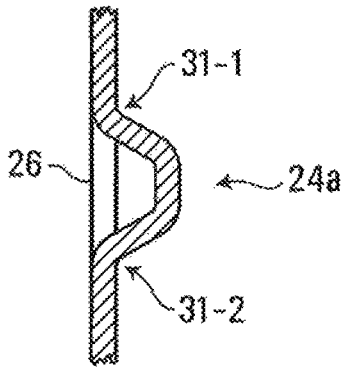
Figure 3:
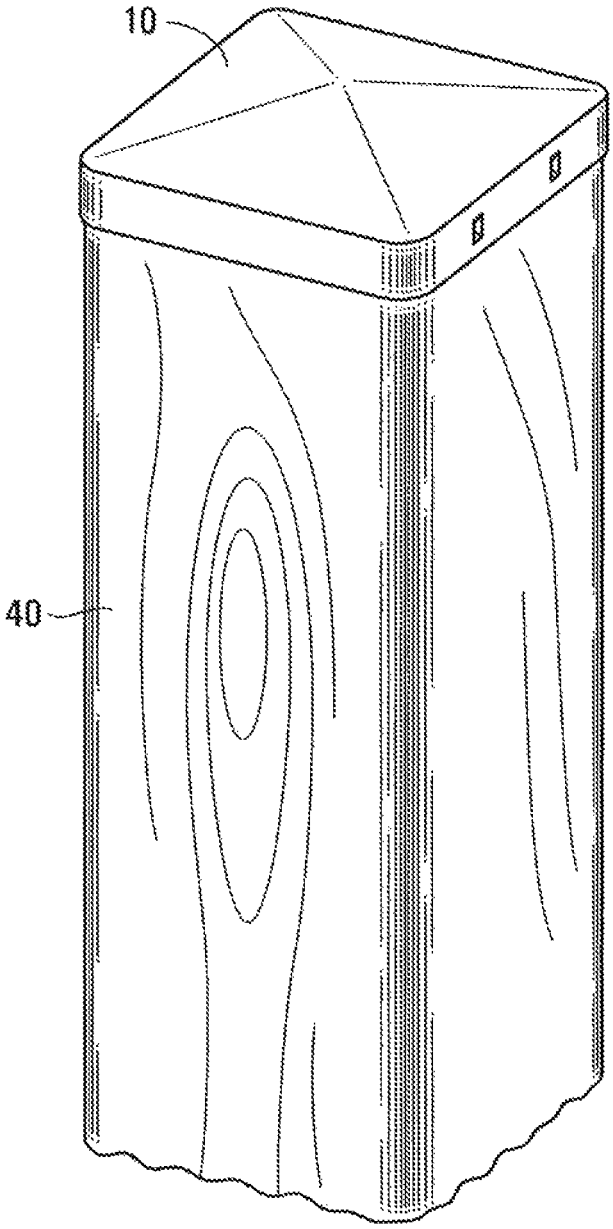
Figure 4:
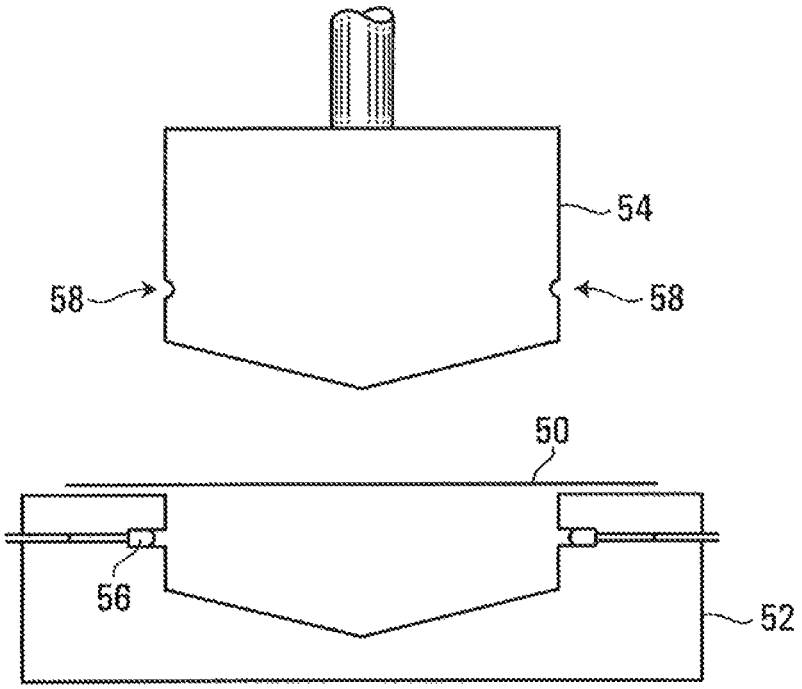

In the figures which illustrate example embodiments of the invention,

FIG. 1 is a partially cut-away perspective view of a fence post cap made in accordance with an embodiment of this invention, FIG. 1A is a bottom plan view of the cap of FIG. 1, FIG. 2 is a cross-sectional fragmentary view along the lines 2-2 of FIG. 1, FIG. 3 is a perspective view of the cap of FIG. 1 installed on a fence post, FIG. 4 is a schematic view of a die for making the cap of FIG. 1.

Figure 7:
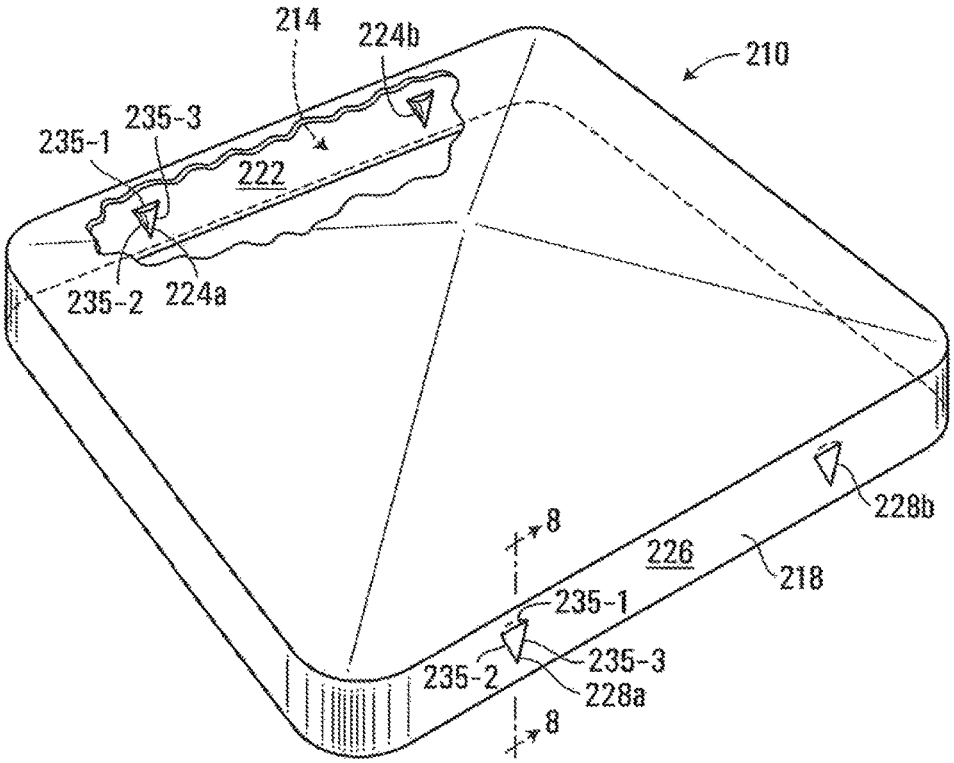
Figure 8:
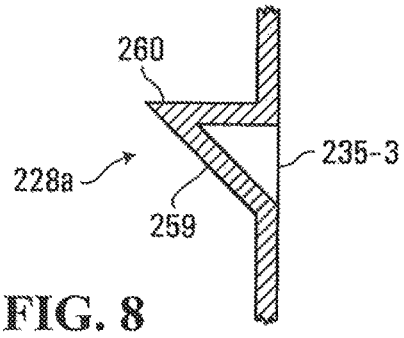
Figure 9:
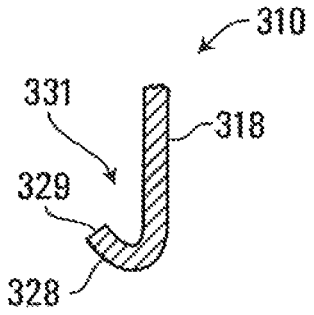
Figure 10:
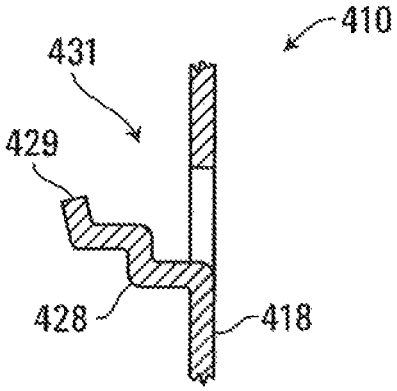
Figure 11:
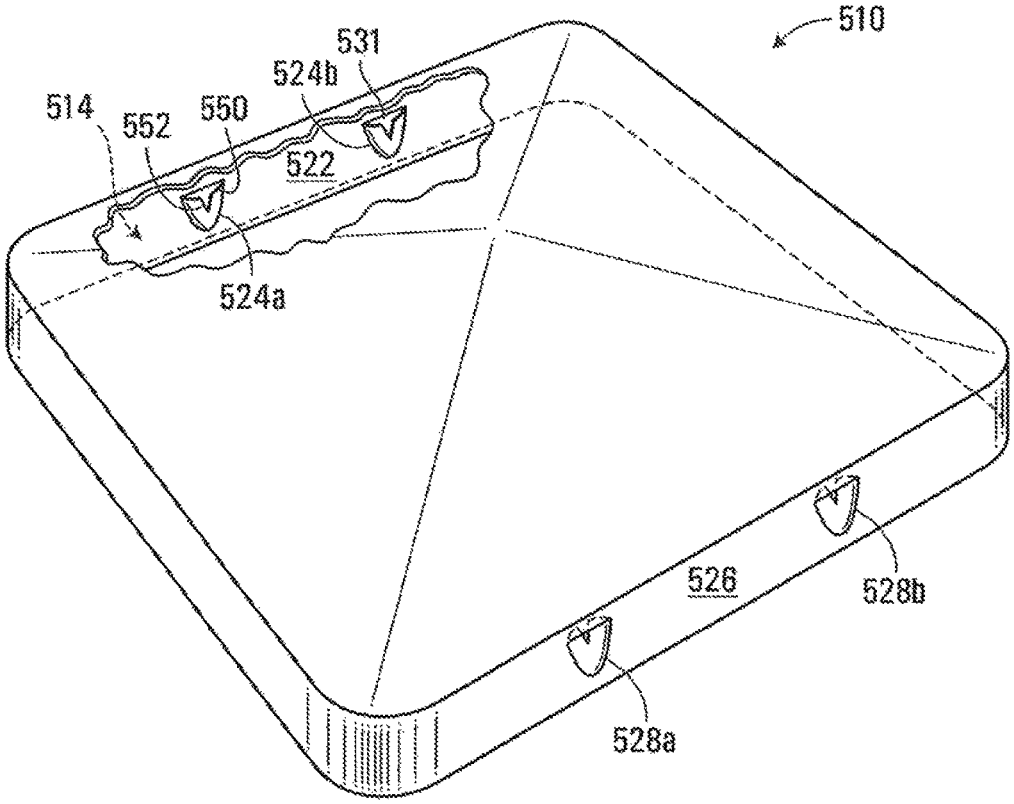

FIG. 5 is a partially cut-away perspective view of a fence post cap made in accordance with another embodiment of this invention, FIG. 6 is a cross-sectional fragmentary view along the lines 6-6 of FIG. 6, FIG. 7 is a partially cut-away perspective view of a fence post cap made in accordance with another embodiment of this invention, FIG. 8 is a cross-sectional fragmentary view along the lines 8-8 of FIG. 7, FIG. 9 is a cross-sectional fragmentary view of a cap made in accordance with a further embodiment of this invention, FIG. 10 is a cross-sectional fragmentary view of a cap made in accordance with yet another embodiment of this invention, and FIG. 11 is a partially cut-away perspective view of a fence post cap made in accordance with another embodiment of this invention.

DETAILED DESCRIPTION

Turning to FIGS. 1 and 1A, a fence post cap 10 is a unitary structure fabricated of sheet metal. The unitary structure has a peaked sheet metal cap portion 11 with four depending sheet metal side walls 12, 14, 16, and 18 and four depending sheet metal corner walls 13, 15, 17, and 19. A first side wall 14 has a planar sheet metal portion 22 and two inwardly extending bent sheet metal portions which form protrusions, or dimples, 24*a*, 24*b*. Similarly, a second side wall 18, opposed to the first side wall 14, has a planar sheet metal portion 26 and two inwardly extending bent sheet metal portions which form protrusions, or dimples, 28*a*, 28*b*. The dimples are located such that dimple 24*a* is opposite dimple 28*a* and dimple 24*b* is opposite dimple 28*b*. With this arrangement, the shortest distance, D1, between the first side wall planar sheet metal portion 22 and the second side wall planar sheet metal portion 26 is greater than the shortest distance, D2, between each opposed pair of dimples 24*a*, 28*a* and 24*b*, 28*b*.

Dimples 28*a*, 28*b* are mirror images of dimples 24*a*, 24*b*. With reference to FIG. 2 along with FIG. 1A, dimple 24*a* is a bent sheet metal portion which is separated from the second side wall planar sheet metal portion 26 along two opposed sides 33-1, 33-2 of the dimple and is unitarily formed with the second side wall planar sheet metal portion 26 along two other opposed sides 31-1, 31-2 of the dimple.

Cap 10 may be generally square such that the distance between sides 12 and 16 is equal to the distance, D1, between sides 14 and 18. With reference to FIG. 3, in use, cap 10 may be press fit over a smooth-walled, generally square, post 40 having a width and depth which is slightly less than distance D1 but greater than D2. The fence post may be wooden or fabricated of fiberglass, iron, or vinyl. Because of the interference fit between the dimples of the cap and the post, the cap is held firmly in place. Further, with the cap secured by a press fit, the cap does not need to abut the top of the fence post. Hence, the cap can be leveled during installation even if the top of the fence post is not entirely level.

Turning to FIG. 4, the cap may be fabricated from a sheet 50 of sheet metal by first die punching sheet 50 between a female die 52 and a male die 54 in order to form a first unitary structure having a sheet metal cap portion and a plurality of depending planar sheet metal side walls. Then four side die punches 56 supported in the female die 52 may be punched into wells 58 in the male die 54 to form the dimples of the cap.

While cap 10 has been shown with four dimples in two opposed side walls, in other embodiments, the cap could have one dimple in each of two opposed side walls, although this is not preferred since the cap may have a tendency to pivot about the two dimples. In a further embodiment, the cap may have one dimple in each of its four side walls. Further, the dimples could be on two opposed corner walls, or on all four corner walls 13, 15, 17, and 19 rather than on the side walls. Other arrangements could also be contemplated.

Fabrication of the fence post cap from a unitary piece of sheet metal has the advantage that the cap, and particularly each dimple of the cap, has some degree of resilience, which facilitates the press fitting of the cap to a post. A sheet metal cap also allows the cap to be formed by die stamping. Nevertheless, some thin-walled plastics also provide a degree of resilience and so it may be possible to form a suitable cap with thin-walled dimples from plastic. Though not as advantageous, in some applications where the post to which the cap will be fitted provides some degree of resilience (such as a wooden post), a thin-walled material which has little resilient, such as a thin-walled glass cap, may be used.

In a further embodiment, with reference to FIGS. 5 and 6, cap 110 has differently configured opposed dimples 124, 128. Specifically, each of the dimples is a laterally elongated bent sheet metal portion which is separated from the planar sheet metal portion 122, 126 of side wall 114, 118, respectively, along respective upper and lower edges 131-1, 131-2 of the dimple and is unitarily formed with the side wall planar sheet metal portion 122 or 126 along opposed sides 133-1, 133-2 of the dimple.

Similarly to cap 10 of FIG. 1, cap 110 of FIG. 5 may be press fit to a fence post. However, in view of the longitudinal extent of the dimples, the post has little tendency to pivot about the dimples.

Optionally, the laterally elongated dimples in the side walls could extend to the corner wall of the cap. As a further option, the dimples could be replaced with an inwardly projecting bent metal protrusion that extends continuously along the side walls and corner walls of the cap. To avoid the laterally elongated dimples, or the continuous protrusion, being visible from the outside of the cap, the cap may be double-walled.

Turning to FIGS. 7 and 8, in yet another embodiment, cap 210 has dimples 224*a*, 224*b* projecting inwardly from a planar portion 222 of wall 214 and dimples 228*a*, 228*b* projecting inwardly from a planar portion 226 of wall 218. Each dimple is a bent metal portion with a triangular outline that is bulged inwardly such that its three sides 235-1, 235-2, and 235-3 are unitarily formed with the side wall planar sheet metal portion 222 of 226. The inward bulge forms an inwardly and upwardly projecting wall 259 terminating at an upper edge 260.

Cap 210 works similarly to cap 10, however, in view of the inwardly and upwardly projecting wall 259, an upward dislodging force on the cap will tend to cause the upper edge 260 of each dimple to bite into the fence post thereby enhancing the secure connection of the cap to the fence post.

In a further embodiment, each inwardly extending protrusion is formed by an upturned bottom lip of each of two opposed side walls of the cap. Each upturned bottom lip projects inwardly and upwardly toward the peaked cap portion of the cap terminating at an upper free end. This embodiment is illustrated in FIG. 9 which shows a portion of a cap 310 side wall 318 with an inwardly and upwardly projecting lip 328 with a upper free end 329. Notably, with this embodiment, there a mouth-like gap 331 between the upper end 329 of the projecting lip and the side wall 318. In a further embodiment the upturned bottom lip may extend along all four side walls, or it could extend continuously along the four side walls and corner walls.

In another embodiment, each inwardly protrusion may have the shape of an inwardly and upwardly projecting tongue. This embodiment is illustrated in FIG. 10 wherein tongue 428 of cap 410 has a generally step-shaped profile so as to inwardly project from wall 418 and project upwardly to its upper free end 429. Again, with this embodiment, there is a mouth-like gap 431 between the upper end 429 of the projecting tongue and the side wall 418.

Like previously described embodiments of the cap, each of caps 310 and 410 may be press fit to a fence post. However, caps 310 and 410 have an advantage over cap 10 in that an upward dislodging force on the cap will tend to cause the free end 329 or 429 of the protrusion to bite into the fence post thereby enhancing the secure connection of the cap to the fence post. Indeed, the bite provided by the protrusion 328 or 428 can be more secure than the bite provided by the dimple of the cap 210 of FIGS. 7 and 8 because material of the post bitten by protrusion 328 or 428 can be pushed into mouth 331 or 431.

Turning to FIG. 11, in a further embodiment, cap 510 has dimples 524*a*, 524*b* projecting inwardly from a planar portion 522 of wall 514 and dimples 528*a*, 528*b* projecting inwardly from a planar portion 526 of wall 518. The upper edge 550 of each dimple is separated from its respective wall 514, 518 to provide a mouth-like gap 531 between the upper edge of each dimple and its respective side 514, 518. Furthermore, a V-shaped notch 552 extends from the upper edge 550 of each dimple. While these notches are shown with a V-shaped taper, optionally the notches could be tapered such that the taper of the notches define other tapering shapes. Where cap 610 is fabricated of sheet metal or thin-wall plastic, a tapered notch gives each dimple a degree of compliance while substantially maintaining the strength of the dimple. While not preferred, alternatively, the notches could have straight side walls.

Cap 510 may be press fit to a fence post. As the cap is press fit, the dimple wall adjacent notch 552 may flex. One press fit in place, an upward dislodging force on the cap will tend to cause upper edge 550 of each dimple to bite into the fence post thereby enhancing the secure connection of the cap to the fence post. Indeed, the bite provided by the notched dimples can be more secure than the bite provided by the dimple of the cap 210 of FIGS. 7 and 8 because material of the post bitten by the notched dimple can be pushed into mouth 531.

While a cap fabricated of a unitary piece of sheet metal allows for simple manufacture and, at least in some of the described embodiments, resilient protrusions, a cap otherwise fabricated may still provide some advantages. For example, a cap could be fabricated from sheet metal without protrusions and then protrusions tack welded to the inside of the cap walls. In this way, for example, the tongues of cap 410 of FIG. 10 or the dimples of cap 510 of FIG. 11 may be tack welded to the cap. In further embodiments, the cap may be fabricated of a material other than sheet metal. For example, the cap could be fabricated of fibreglass, plastic, or glass. In such instance, the cap could be molded from a single piece of material, or the protrusions, such as the tongues of cap 410 or the dimples of cap 510 could be fused to the cap after initial manufacture.

Other embodiments will be apparent to those skilled in the art and, therefore, the invention defined in the claims.

What is claimed is:

1. A fence post cap, comprising:

a unitary structure fabricated of sheet metal, said unitary structure having a sheet metal cap portion above a plurality of depending sheet metal walls, each wall of said walls joined at either end to an adjacent wall of said walls;

a first wall of said walls having a first protrusion extending inwardly and upwardly to a first protrusion edge which is discontinuous from said first wall, said first protrusion having opposed top and bottom portions and opposed side wall portions and having a gap formed between said first wall and said first protrusion edge, said gap extending through said opposed side wall portions, said first protrusion integrally formed with said first wall at said opposed top and bottom portions, said first protrusion edge extending between said opposed top and bottom portions, said first protrusion being wider at said first protrusion edge than at a bottom portion of said first protrusion;

a second wall of said walls, opposed to said first wall, having a second protrusion extending inwardly and upwardly to a second protrusion edge which is discontinuous from said second wall, said second protrusions having opposed top and bottom portions and opposed side wall portions and having a gap between said second wall and said second protrusion edge, said gap extending through said opposed side wall portions, said second protrusion integrally formed with said second wall at said opposed top and bottom portions, said second protrusion edge extending between said opposed top and bottom portions, said second protrusion being wider at said second protrusion edge than at a bottom portion of said second protrusion, said inwardly extending first protrusion being opposed to said inwardly extending second protrusion;

wherein a shortest distance between said first wall adjacent said inwardly extending first protrusion and said second wall adjacent said inwardly extending second protrusion is greater than a shortest distance between said inwardly extending first protrusion and said inwardly extending second protrusion.

2. The fence post cap of claim 1 wherein said second protrusion is a mirror image of said first protrusion.

3. The fence post cap of claim 2 wherein said first wall is a first side wall and said second wall is a second side wall and further comprising a third side wall and an opposed fourth side wall extending between said first side wall and said second side wall.

4. A fence post cap, comprising:

a thin-walled cap portion above a plurality of depending thin walls;

a first wall of said walls having an inwardly extending thin-walled first protrusion joined to said first wall along a first non-linear continuously curved line, said first protrusion having a first inner edge providing a mouth between said first wall and said first inner edge, said first protrusion having a first notch extending from a middle portion of said first inner edge so as to form corners where said first notch meets said first inner edge;

a second wall of said walls, opposed to said first wall, having an inwardly extending thin-walled second protrusion joined to said second wall along a second non-linear continuously curved line, said second protrusion having a second inner edge providing a mouth between said second wall and said second inner edge, said second protrusion having a second notch extending from a middle portion of said second inner edge so as to form corners where said second notch meets said second inner edge.

5. The fence post cap of claim 4, wherein said first notch is a V-shaped notch.

6. The fence post cap of claim 5 wherein said first protrusion has a convexly curved first face, said first notch extending from said first inner edge into said convexly curved first face.

7. The fence post cap of claim 4 wherein a bottom of said first protrusion is joined to said first wall along said first non-linear continuously curved line.

8. The fence post cap of claim 4 wherein opposite sides of said first protrusion are joined to said first wall along said first non-linear continuously curved line.

9. The fence post cap of claim 4 wherein said first wall is a first side wall and said second wall is a second side wall opposite said first side wall.

10. The fence post cap of claim 4 wherein said cap portion, said depending walls, and each said protrusion comprise a unitary structure fabricated of sheet metal.

11. The fence post cap of claim 4 wherein said first protrusion has a convexly curved first face, said first notch extending from said first inner edge into said convexly curved first face.

12. A fence post cap, comprising:

a unitary structure fabricated of sheet metal, said unitary structure having a sheet metal cap portion above a plurality of depending sheet metal walls, each wall of said walls joined at either end to an adjacent wall of said walls;

a first wall of said walls having a first protrusion extending inwardly and upwardly to a first protrusion edge which is discontinuous from said first wall, said first protrusion having opposed top and bottom portions and opposed side wall portions and having a gap formed between said first wall and said first protrusion edge, said gap extending through said opposed top and bottom portions, said first protrusion integrally formed with said first wall at said opposed side wall portions, said first protrusion edge extending between said opposed side wall portions, said first protrusion being wider at said first protrusion edge than at a side wall portion of said first protrusion;

a second wall of said walls, opposed to said first wall, having a second protrusion extending inwardly and upwardly to a second protrusion edge which is discontinuous from said second wall, said second protrusions having opposed top and bottom portions and opposed side wall portions and having a gap between said second wall and said second protrusion edge, said gap extending through said opposed top and bottom portions, said second protrusion integrally formed with said second wall at said opposed side wall portions, said second protrusion edge extending between said opposed side wall portions, said second protrusion being wider at said second protrusion edge than at a side wall portion of said second protrusion, said inwardly extending first protrusion being opposed to said inwardly extending second protrusion;

wherein a shortest distance between said first wall adjacent said inwardly extending first protrusion and said second wall adjacent said inwardly extending second protrusion is greater than a shortest distance between said inwardly extending first protrusion and said inwardly extending second protrusion.

* * * * *